United States Patent [19]

Lisart

[11] Patent Number: 4,832,528

[45] Date of Patent: May 23, 1989

[54] WATERTIGHT WALLS FOR HYDRAULIC STRUCTURES IN COMPACTED CONCRETE AND METHODS FOR CONSTRUCTING SAID WALLS

[76] Inventor: Jean G. Lisart, 25, Chanteperdrix - Le Tholonet, 13100 Aix-en-Provence, France

[21] Appl. No.: 175,753

[22] Filed: Mar. 31, 1988

[30] Foreign Application Priority Data

Apr. 3, 1987 [FR] France ..... 87 04848

[51] Int. Cl.[4] ..... E02B 7/02

[52] U.S. Cl. ..... 405/116; 405/107; 405/109

[58] Field of Search ..... 405/107, 108, 109, 258, 405/262, 284, 285, 286, 287

[56] References Cited

U.S. PATENT DOCUMENTS

| | | | |
|---|---|---|---|
| 2,008,472 | 7/1935 | Seailles | 405/107 |
| 2,752,774 | 7/1956 | Steinboeck | 405/107 X |
| 2,949,743 | 8/1960 | Scheidenhelm | 405/107 |
| 4,369,004 | 1/1983 | Weatherby | 405/262 |
| 4,659,252 | 4/1987 | Sexton et al. | 405/107 X |

FOREIGN PATENT DOCUMENTS

| | | | |
|---|---|---|---|
| 181981 | 12/1903 | Fed. Rep. of Germany . | |
| 1255590 | 11/1967 | Fed. Rep. of Germany | 405/107 |
| 1263625 | 3/1968 | Fed. Rep. of Germany | 405/107 |
| 2640665 | 3/1977 | Fed. Rep. of Germany . | |
| 2745410 | 4/1979 | Fed. Rep. of Germany . | |
| 80491 | 5/1934 | Sweden | 405/107 |
| 220852 | 3/1969 | U.S.S.R. | 405/107 |

*Primary Examiner*—Dennis L. Taylor

*Attorney, Agent, or Firm*—Bucknam and Archer

[57] ABSTRACT

Watertight wall for a dam or a dyke, composed of a plurality of horizontal layers of compacted earth-fillings, the wall comprising a rear wall which is composed of prefabricated panels of height equal to the height of several layers, each panel being equipped with buttresses situated at the back of the panels, which buttresses are embedded in the embankment of earth-fillings and are equipped wiht draining pipes, the wall further comprising a continuous sealing layer which is cast against the front face of the prefabricated panels.

11 Claims, 6 Drawing Sheets

WATERTIGHT WALLS FOR HYDRAULIC STRUCTURES IN COMPACTED CONCRETE AND METHODS FOR CONSTRUCTING SAID WALLS

FIELD OF THE INVENTION

The present invention relates to watertight walls for hydraulic structures in compacted concrete and to methods for building such walls.

BACKGROUND OF THE INVENTION

The technical sector of the invention is that of public works and in particular the building of dams or dykes with embankments of earth-fillings mixed with cement and compacted, normally known as roller-compacted concrete.

One of the problems to be solved with this type of hydraulic structure is that of obtaining a substantially watertight wall upstream, i.e. on the side in contact with the water retained by the structure.

Another problem is to build a substantially watertight wall combined with means permitting a quick draining of the water which has infiltrated behind such wall. It is indeed important, when emptying out the retained water, that no appreciable difference sets up between the level of the restrained water and the level of the water confined behind the wall, as this would create a pressure on that wall which could loosen off the upstream side of the wall of the structure.

It is also important to prevent water from invading the mass of compacted concrete, as this could create uplifts dangerous for the stability of the structure.

It is recalled that structures built in roller-compacted concrete are made up of horizontal layers of earth-fillings mixed with a binder, normally cement, in the proportion of 80 to 150 Kg of cement per m3 of fillings.

Such layers are around 30 cm thick and they are laid and compacted one after the other, with a compaction roller rolling over the layer to be compacted.

The upstream and downstream embankments cannot be roller-compacted and heretofore, various other solutions have been used for treating the faces of such structures, and particularly the upstream face which is required to be substantially watertight and which can be either vertical or inclined.

Methods for constructing a watertight upstream wall are known wherein a wall in conventional reinforced concrete is cast in situ, in successive layers, behind a conventional form or a slip form.

According to some of the conventionally known methods, a layer of earth-fillings mixed with a binder is first deposited, and then compacted, part of the less-compacted earth-fillings constituting the upstream embankment is removed, and a strip of reinforced concrete of the same height as the layer of compacted concrete is cast between a form and said compacted concrete.

According to other conventionally known methods, successive horizontal strips of reinforced concrete are cast, said strips having a height equal to that of two or three layers of earth-fillings and the layers of earth-fillings are deposited one after the other, behind the reinforced concrete wall.

With all these solutions, it is necessary to coordinate the building of the reinforced concrete wall with the laying and compacting of the earth-fillings, which considerably lengthens the works schedule and the non-productive periods.

Another known method consists in constructing a watertight upstream wall composed of prefabricated concrete panels of height equal to that of several layers of earth-fillings, said panels being provided on their internal face with a synthetic moisture barrier and with anchoring members embedded in the mass of compacted concrete, which latter has been deposited and compacted, layer by layer, after positioning of a prefabricated panel.

Yet another known solution consists of placing the binder-enriched earth-fillings behind an upstream form and of adhesively bonding a moisture barrier on the facing after stripping the forms. This solution implies the difficulties of preparing the facing after form stripping and can cause loosening off of the moisture barrier. In addition, said moisture barrier is not protected.

SUMMARY OF THE INVENTION

It is the object of the present invention to propose methods of constructing the upstream walls of hydraulic structures in roller-compacted concrete as well as new walls which can be vertical or inclined and which have three functions:

part of the wall, which is prefabricated, is fitted into place before constructing each layer of compacted earth-fillings and serves as a support for the embankment while this is constructed and compacted;

the prefabricated part serves as support for a continuous sealing layer which may be built independently, for example after completion of the construction of the whole embankment;

the prefabricated part is designed in such a way as to ensure an efficient draining of the structure in combination with the less compacted layer of earth-fillings situated behind the upstream wall.

This object is reached according to the invention with watertight walls comprising:

a rear wall which is composed of superposed prefabricated panels, the height of which is substantially equal to the thickness of several layers of compacted concrete, said panels being equipped at the back with buttresses containing a draining channel and reinforcing bars traversing said prefabricated panels;

and a continuous watertight layer which is cast against the front face of said panels.

According to a first embodiment of the invention, the watertight layer is a layer of reinforced concrete, which is cast between said panels and a form, and in which the reinforcements are joined to the reinforcing bars of said rear buttresses.

According to another embodiment of the invention, the wall further comprises an external layer formed by prefabricated slabs of reinforced concrete, said slabs comprising reinforcing bars perpendicular thereto and means for joining said bars to the ends of the bars reinforcing said rear buttresses and for keeping a free space between said external layer and said panels, and said watertight layer being cast in situ and in said free space.

Advantageously, the rear buttresses are provided with a boss at their free end.

According to a preferred embodiment, the draining channels are situated at the rear end of the buttresses.

Advantageously, the rear buttresses are elements which are prefabricated separately and which are secured to said prefabricated panels by means of nuts screwed on said reinforcing bars which are threaded to this effect.

The invention therefore proposes new watertight walls placed upstream of hydraulic structures in compacted concrete which are constructed by successive horizontal layers.

The advantage of the walls according to the invention, which consist of a prefabricated back wall made up of panels and buttresses, which are fitted gradually and before the embankments are constructed, is that said panels serve as supports for the embankment until the cement has set, so as to obtain vertical walls or walls that are inclined at an angle greater than the angle of the natural slope of the embankments.

Moreover, the fact of positioning the buttresses before constructing the embankments, makes it possible to embed said buttresses in a layer of less compacted earth-fillings, which thereafter, forms a layer of porous concrete immediately behind the sealing layer.

The buttresses then serve as anchor means for the structure wall. Also, as the butrresses contain draining channels, said channels, together with the layer of porous concrete surrounding them, procure an efficient draining of the concrete behind the sealing wall, this preventing any loosening off of the wall due to a level of water behind the wall which is higher than the level of water at the front of the wall.

The walls according to the invention further comprise a sealing layer which is cast in situ against the prefabricated back wall, already constructed and anchored to the structure. The result is a completely watertight wall, which can be built after the construction of the earth-filling embankment, without having to coordinate the construction works as in the conventionally known methods where a concrete wall is cast in successive layers as the structure rises. The sealing layer is joined to the reinforcements which are embedded in the rear buttresses, thereby achieving an excellent bond between said sealing layer, the back wall and the structure proper.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
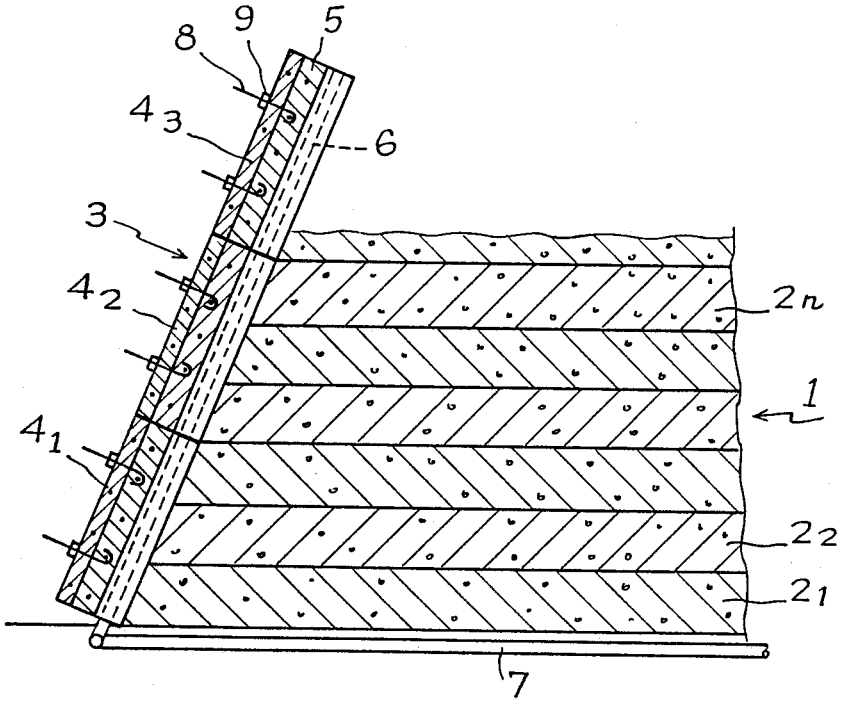
FIG. 1 is a vertical section of the front wall of a hydraulic structure being built.

Referring first to FIG. 1, this shows a partial cross-section of a hydraulic structure 1, such as for example a dam or a dyke for retaining water. Said structure is built as an embankment of binder-enriched earth-fillings, this material being conventionally known as roller-compacted concrete.

The embankment is built in successive horizontal layers $2_1$, $2_2$. . . 2n, which are individually compacted with a compaction roller rolling over the embankment, and which have a thickness of about 30 cm.

FIG. 1 shows a partial section of the upstream wall 3, i.e. the wall which is placed in contact with the retained water. FIG. 1 shows the structure being built, after completion of the layer $2n$, and during the forming over it of a layer $2n+1$.

The wall 3 comprises prefabricated panels in reinforced concrete $4_1$, $4_2$, $4_3$ etc. which panels are superposed. Each panel has a height equal to the thickness of several layers 2 of compacted concrete.

FIG. 1 illustrates one particular embodiment in which each panel 4 has a height of 1 meter, which corresponds to the thickness of three layers of about 30 cm.

Each panel 4 is provided at the back with a plurality of buttresses 5, such as for example two buttresses which are symmetrical with respect to the vertical median plane of the panel, and spaced apart of a distance equal to half the width of each panel. For example, panels 4 have a width of 2 meters and the interval between two buttresses is 1 meter.

The embankment extends up to panels $4_1$, $4_2$. . . $4n$ which form a continuous retaining covering and the buttresses 5 protruding from the back of the panels are embedded in the embankment and constitute a very strong anchorage means for the wall in the compacted concrete.

Each buttress 5 contains a perforated drain pipe 6 which is embedded in the buttress, said latter comprising channels connecting the drain pipe 6 with the outside.

The buttresses of the superposed panels are aligned end-to-end, so that the drain pipes 6 of the various superposed buttresses form a draining channel which communicates with an evacuation pipe system 7 embedded in the ground or in the base layer of the structure.

Each buttress 5 comprises reinforcing bars 8 traversing the prefabricated panels 5 and which are joined to the internal reinforcements of the buttress.

The height of said buttresses 5 is equal to that of the panels.

FIGS. 1 and 3 to 5 illustrate one preferred embodiment in which the buttresses 5 are prefabricated separately and are assembled with the panels 4 by nuts 9 which are screwed on the threaded end of reinforcing bars 8. In such a case, the panels can be assembled with the buttresses in the factory.

In the illustrated example, the buttresses associated to each panel extend through the full height of the panel. But it is to be noted that this example is in no way restrictive.

Figure 2:
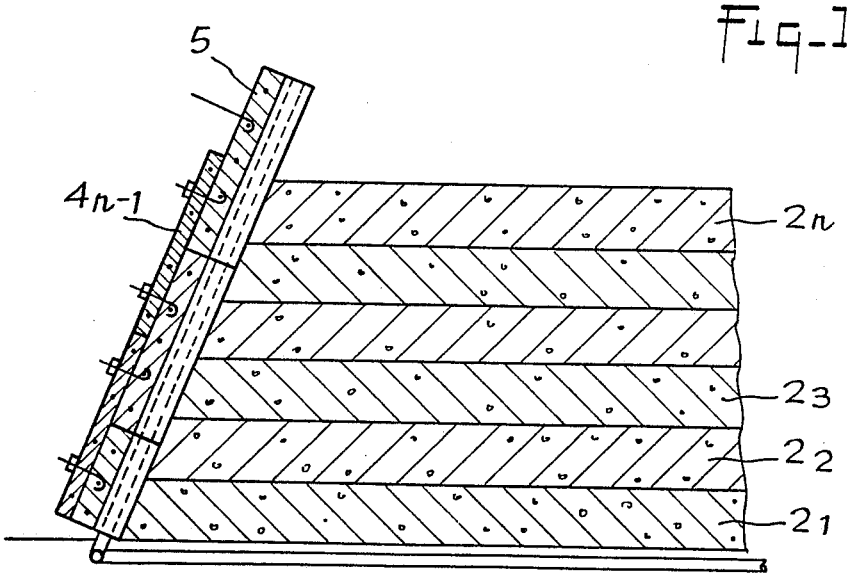
FIG. 2 is a vertical section of a variant embodiment.

It is also possible to assemble the prefabricated buttresses 5 with the prefabricated panels 4, on the site, as illustrated in FIG. 2, i.e. by shifting the buttresses of half a height-length, the advantage of this being that each new panel $4n$ which is positioned, rests against a buttress 5 which is fixed to panel $4n-1$ and which is anchored over half its height in the last already built layer of compacted concrete. As a result, panel $4n$ shows good resistance to tipping over while the laying and compacting of the embankment is in progress.

According to another variant, illustrated in FIGS. 1 and 3 to 5, each panel 4 can be produced in one piece with its two buttresses. In this case, the nuts 9 are no longer necessary.

Figure 3:
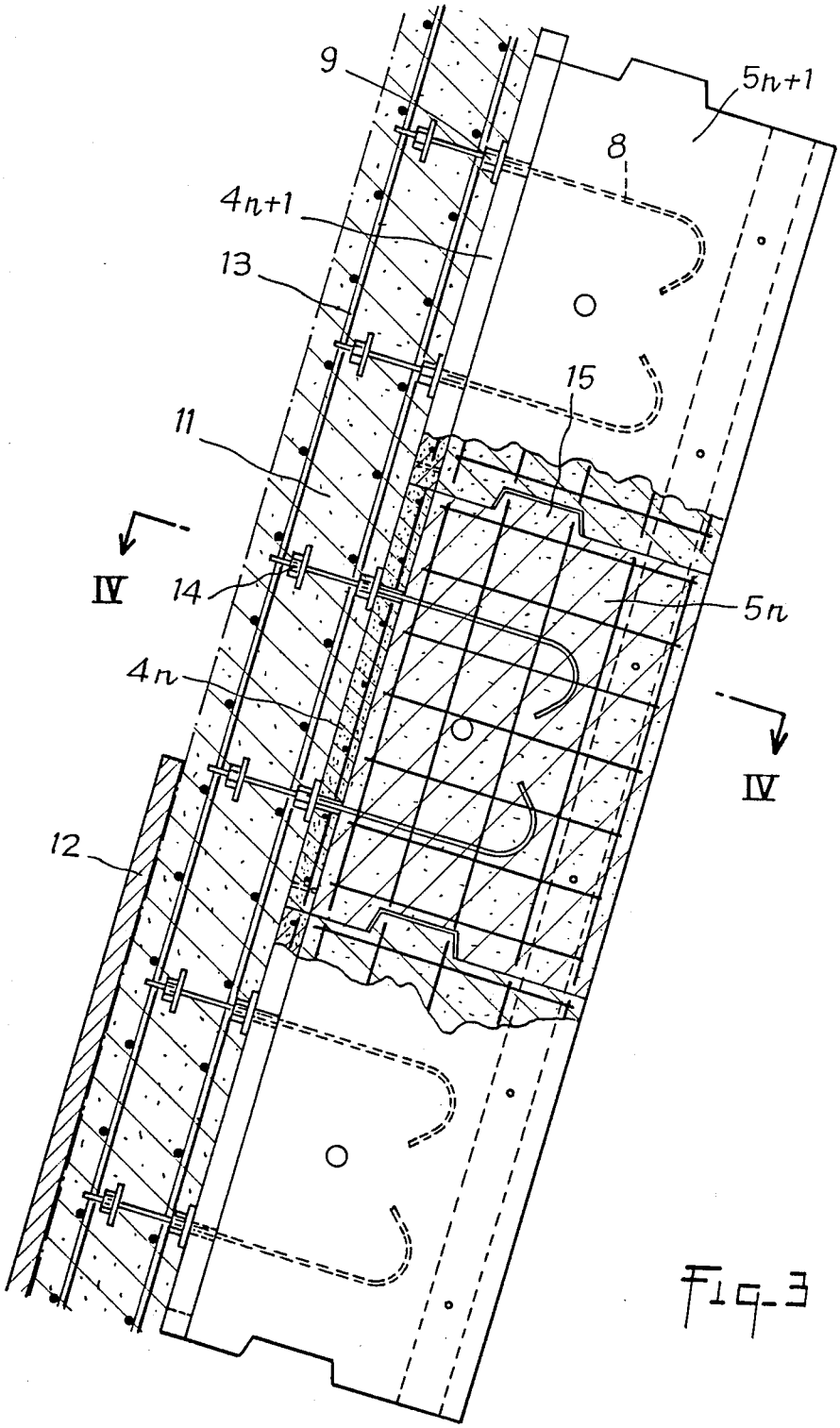
FIGS. 3 and 4 are, respectively, a vertical section and a horizontal section of a first embodiment of a wall according to the invention.

FIG. 3 illustrates a vertical section, on an enlarged scale, of a section of upstream wall in a hydraulic structure.

Figure 4:
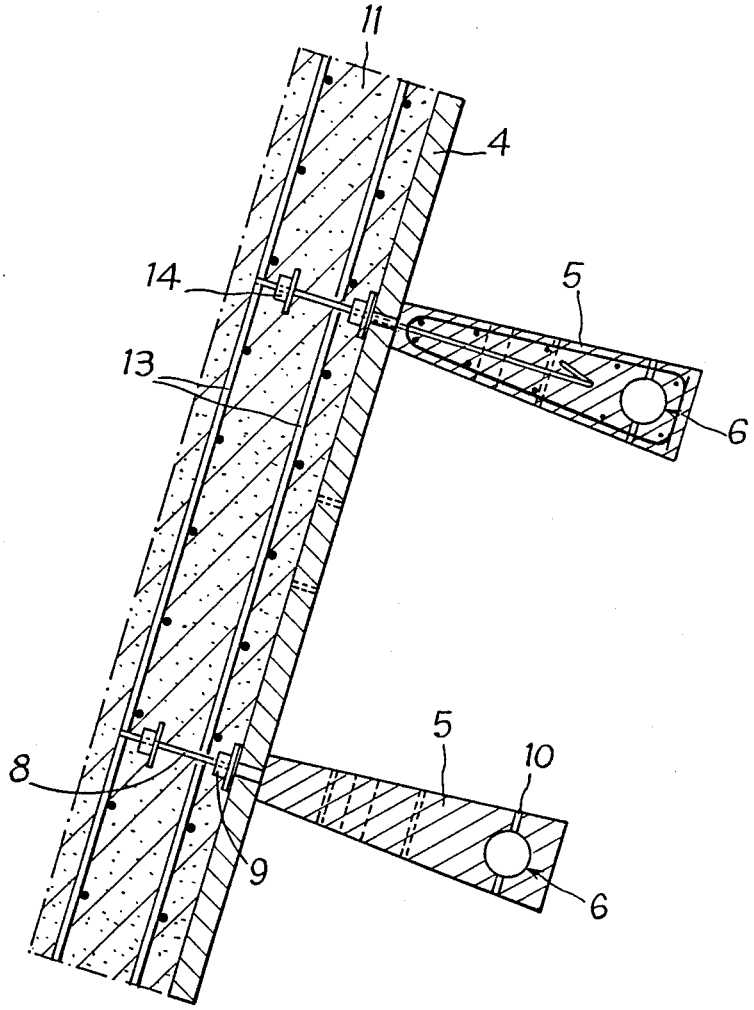

FIG. 4 illustrates a cross-section along line IV—IV of FIG. 3.

Both these figures show two superposed prefabricated panels $4n$ and $4n+1$ and the buttresses $5n$ and $5n+1$ which are fixed to the back face of each panel by means of nuts 9 screwed on the anchoring bars 8 which are embedded in the buttresses and which traverse the panels 4 provided with holes to this effect.

FIG. 4 shows one example of embodiment in which the buttresses 5 have a trapezoidal cross-section, the larger base of which is situated at the rear end opposite to the panel, the effect of this being to improve the anchoring of the buttresses in the compacted concrete.

Drain pipes 6 are situated in the wider part of the buttresses where there is sufficient volume to house them. FIG. 4 also shows the channels 10 which are drilled through the buttresses and which communicate with the pipes 6.

Obviously, the buttresses may have other cross-sectional shapes. Advantageously, the buttresses are provided at their rear end with a boss in which the drain pipe 6 can be housed and which improves the anchoring in the compacted concrete.

The embankment which is built between the buttresses is less compacted. As a result, the buttresses are situated in a layer of porous concrete and the drain pipes 6 are surrounded by said porous layer, this representing a very efficient means of draining the zone situated at the back of the watertight wall, hence of avoiding all risks of a water-level difference occurring between the back and the front of the tight wall when the retained water is drained out.

FIGS. 3 and 4 represent an embodiment in which the upstream wall further comprises a layer of reinforced concrete 11 which is cast in situ in the space bewteen a form 12, which is either a conventional form or a slip or lift from, and the panels 4.

The layer 11 can be cast after the compaction of the concrete structure, in order to avoid the need of coordinating the respective works.

The reinforcing bars 8 are anchored in the concrete of the reinforced concrete layer, for example by way of nuts 14 screwed on the bars 8 or by adherence or any other equivalent anchoring means.

The rear buttresses 5 are provided on their upper and lower faces with sunk or raised recesses 15, i.e. mortises and tenons, which cooperate when two buttresses are superposed.

Similarly, the prefabricated panels 4 present on their lower and upper edges recesses 15*a* which cooperate together when the panels are superposed.

Figure 5:
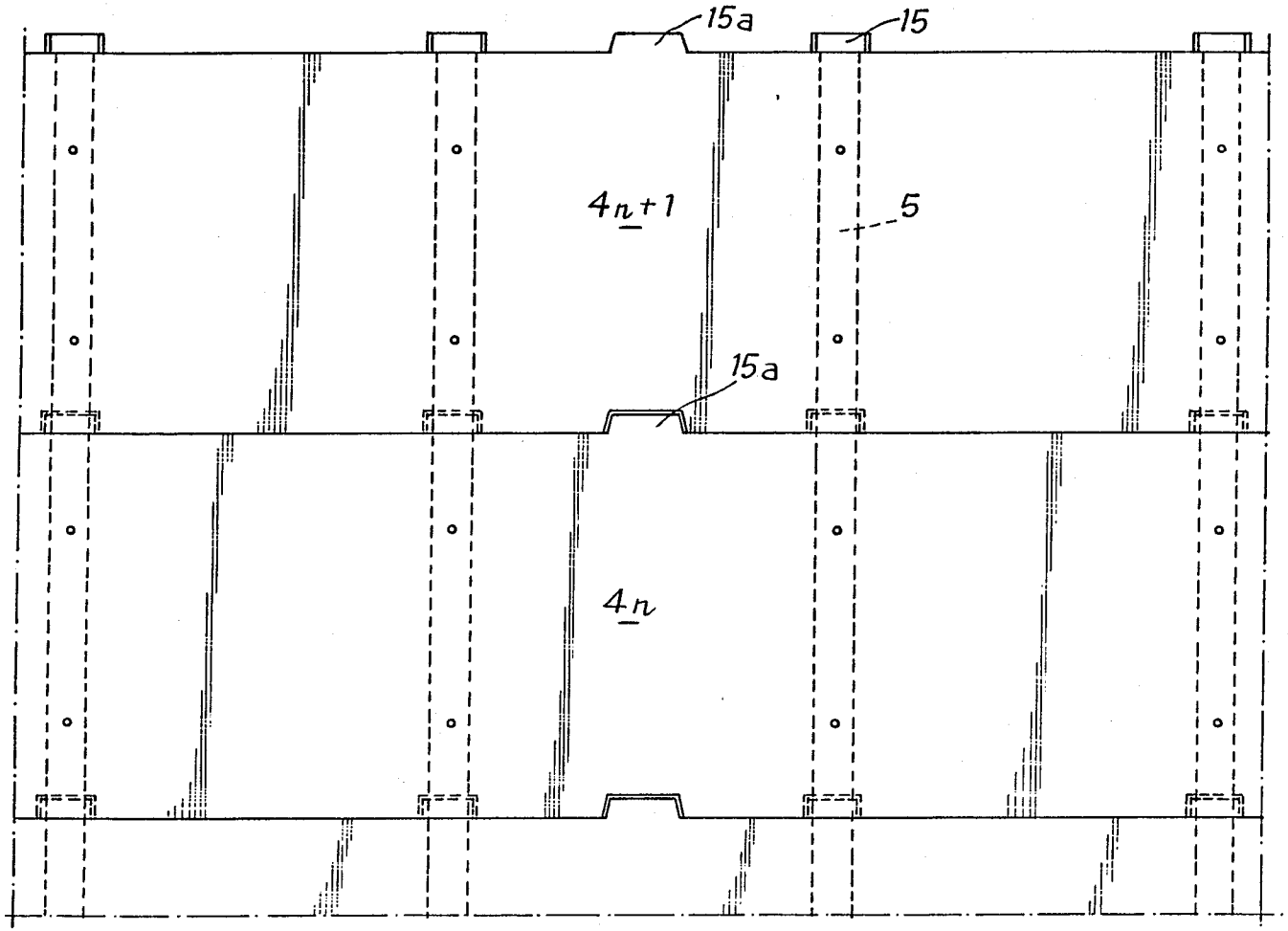
FIG. 5 is a front view of part of the bank wall.

FIG. 5 is a front view of the back wall. This view corresponds to an embodiment in which the joints between the panels 4 are in alignment, and the recesses 15*a* are situated in the middle of the length of the panels. As a variant, panels 4 can be assembled by lap joints. In this case, the panels 4 are provided with half-recesses on the ends of their upper and lower edges.

Figure 6:
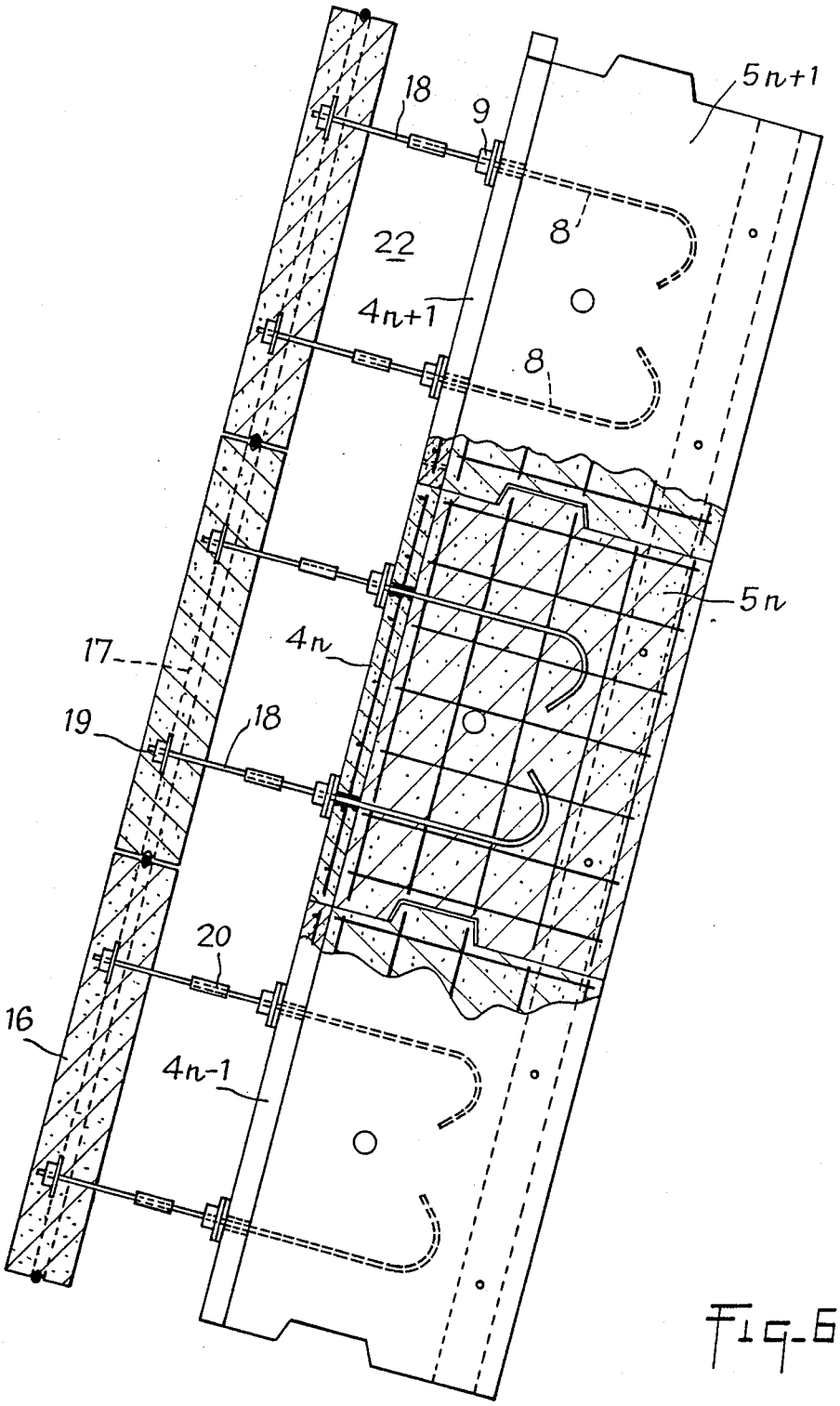
FIGS. 6 and 7 are, respectively, a vertical section and a horizontal section of a second embodiment of a wall according to the invention.
Figure 7:
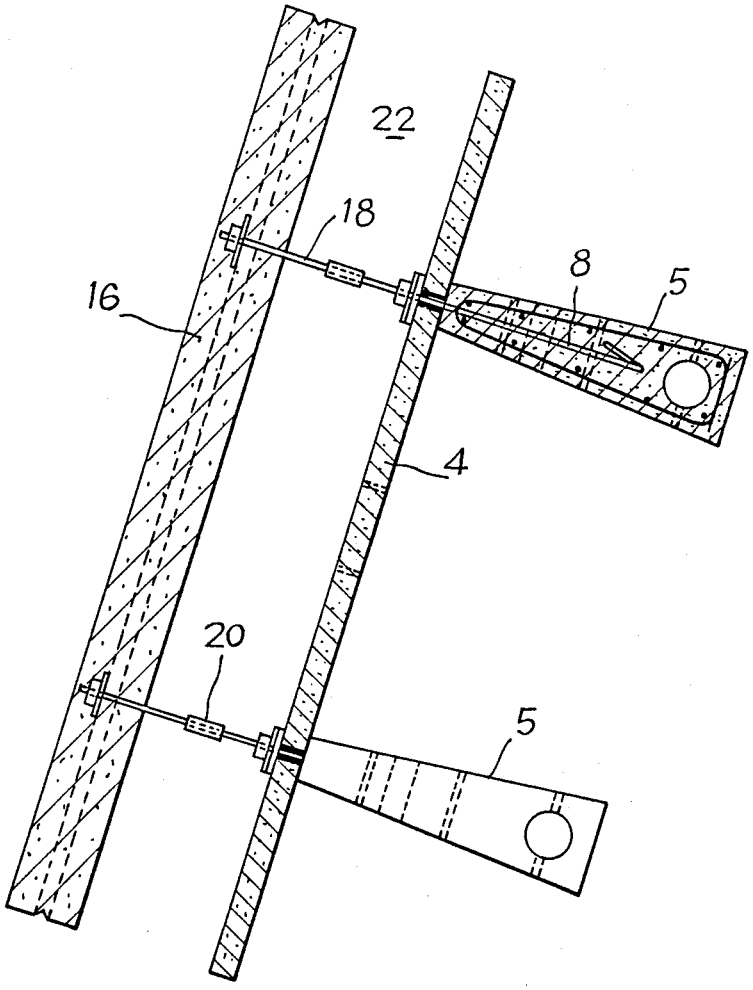

FIGS. 6 and 7 show vertical and horizontal sections of another embodiment of an upstream retaining wall. The construction of the rear wall remains unchanged. The rear wall is still composed of prefabricated panels $4n-1$, $4n$, $4n+1$ whicha re juxtaposed and which are associated to rear buttresses $5n$, $5n+1$ embedded in the compacted concrete.

According to this particular embodiment, the front wall comprises a prefabricated protection layer or skin, which is composed of prefabricated slabs 16 in reinforced concrete. Slabs 16 comprise internal reinforcements 17 and bars 18 adapted to be joined to the reinforcements 17 via nuts 19 or any other equivalent connection means. The bars 18 project from the back face of slabs 16, and they are arranged so as to coincide with the holes provided in the panels 4 for the passage of the bars 8. Each bar 18 is connected with a bar 8 via a reverse pitch threaded sleeve 20 or any other equivalent means.

For example, bars 8 can end in threaded anchoring connectors, or in tulip-shaped anchoring feet which can be embedded in the concrete of the buttresses and the bars 18 then traverse the panels 4 and fit into the connectors.

As illustrated in FIGS. 6 and 7, each slab 16 is provided, all around its periphery, with a seal 21, such as a sealing bead or an O-ring placed inside a groove or any other equivalent sealing means.

Slabs 16, when positioned, constitute a continuous and substantially watertight external skin which protects the sealing layer against damages due to shocks (floating bodies) or weathering agents.

The slabs 16 also constitute an external form which is held at a predetermined distance from the rear panels by the reinforcing bars 18.

The positioning of slabs 16 may be simultaneous with the positioning of the panels 4 situated at the same height.

Advantageously, each slab 16 can be assembled with a panel 4 and its two buttresses at the factory, in order to form a prefabricated element such as that shown in FIG. 7.

As a variant, the slabe 16 may be positioned in a second step when the dam is completed. Once the slabs 16 are fitted, they define with the panels 4 a free space 22 of thickness ranging between 5 cm and 50 cm, depending on the nature of the structure and of the sealing layer. When the structure is completed and all the slabs 16 are placed, a sealing layer is cast in space 22, which layer can be composed of asphalt concrete or of hot cast liquid asphalt mastic, or of bentonite cement or of reinforced concrete.

As a variant, the sealing layer may be cast by successive sections, as the successive layers of embankment are built.

FIGS. 1 to 7 illustrate examples of an inclined upstream wall. It is however understood that such wall could also be vertical.

What is claimed is:

1. A watertight wall for an hydraulic structure of compacted concrete composed of a plurality of superposed layers which are consecutively spread and compacted, comprising a rear wall placed in contact with said compacted concrete, said rear wall being composed of superposed and adjacent prefabricated concrete panels having height equal to the thickness of a plurality of layers of compacted concrete, each panel being equipped with prefabricated buttresses of reinforced concrete, said buttresses having a front edge secured against the rear face of each of said panel, a height equal to the height of each of said panels and an enlarged rear end, said buttresses being superposed and being provided with reinforcing bars traversing each of said prefabricated panels, said panels having a front face said water tight wall comprises a continuous sealing layer which is cast in situ against the front face of said prefabricated panels.

2. A watertight wall for an hydraulic structure of compacted concrete composed of a plurality of superposed concrete layers which are consecutively spread and compacted, comprising a rear wall in contact with said compacted concrete, said rear wall being composed of superposed and adjacent prefabricated concrete panels forming a continuous wall, said panels having a rear face, and a front face, and of prefabricated buttresses of reinforced concrete protruding from the rear face of each of said panels, said buttresses having a height equal to the height of each of said panels, said buttresses being superposed, having an enlarged rear end and being provided with reinforcing bars traversing said prefabricated panels, said bars being secured to said panels, said buttresses comprising on their upper and lower faces respectively a transverse stud and a transverse recess which cooperate when two buttresses are superposed, said water tight wall comprising a continuous sealing layer which is cast in situ against said front face of said prefabricated panels.

3. The wall according to claim 1 wherein said buttresses contain a draining pipe housed in each buttress and each buttress is fitted with channels which connect said drain pipe with the outside of said buttress whereby the drain pipes of the superposed buttresses form a draining channel.

4. The wall according to claim 1 wherein said buttresses have a trapezoidal cross-section, the larger base of which is situated at the rear end opposite to each of said prefabricated panels.

5. The wall according to claim 1 wherein each of said buttresses is provided with a boss along its rear end.

6. The wall according to claim 7 wherein said reinforcing bars have threaded free ends, said buttresses are separately prefabricated and are secured to said prefabricated panels by means of nuts screwed on said threaded free ends of said reinforcing bars traversing said prefabricated panels.

7. A watertight wall for an hydraulic structure of compacted concrete composed of a plurality of superposed layers which are consecutively spread and compacted comprising a rear wall placed in contact with said compacted concrete, said rear wall being composed of superposed and adjacent prefabricated concrete panels, said panels having a rear face and having a height equal to the thickness of several layers of compacted concrete and of prefabricated buttresses of reinforced concrete, said buttresses protruding from the rear face of each of said panels, said buttresses have a height equal to the height of each of said panels, said buttresses are superposed, have a rear end enlarged, are provided with reinforcing bars traversing said prefabricated panels and are secured to each of said panels, said water tight wall comprising a front wall composed of a plurality of prefabricated slabs of reinforced concrete, said slabs being superposed adjacent and equipped with reinforcing bars perpendicular to said slabs, said reinforcing bars have ends, said reinforcing bars are joined to the ends of said reinforcing bars of said buttresses traversing said prefabricated panels whereby a free space between said front wall and said back wall is left, said water tight wall comprising a continuous sealing layer cast in situ in said free space.

8. The wall according to claim 1 wherein said sealing layer is reinforced concrete cast in situ between said panels and a conventional form and the reinforcing bars of said layer are joined to the reinforcing bars of said buttresses traversing said prefabricated panels.

9. A method of constructing a watertight wall of an hydraulic structure composed of a plurality of superposed layers of compacted concrete which are spread and compacted one after the other, comprising the following steps:

1. building a retaining wall up by superposing a row of juxtaposed, prefabricated concrete panels upon a row of similar panels previously put in place, the height of the panels being equal to the thickness of said plurality of layers, said panels being equipped with rear buttresses secured to the rear face of said panels, said buttresses being superposed to similar buttresses embedded in said layers previously spread and compacted, each buttress being fitted on the lower edge thereof with a transverse stud or recess which engages a corresponding stud or recess on the upper edge of the buttress to which said buttress is superposed;
2. after said retaining wall has been built, spreading and compacting consecutively several layers of concrete, said panels retaining the concrete and said buttresses preventing said panels from being upset during this operation; 3. repeating the same operations up to the completion of the compacted concrete structures, said panels having a front face, and after completion of the compacted concrete structure;
4. casting a continuous sealing layer against the front face of said prefabricated panels.

10. The method according to claim 9 wherein said sealing layer is composed of concrete reinforced with reinforcing bars and said buttresses are provided with first reinforcing bars traversing said prefabricated panels, said reinforcing bars of said buttresses are secured to said reinforcing bars of said sealing layer and said concrete sealing layer is cast in situ between said front face of said prefabricated panels and a conventional or slip form.

11. The method according to claim 9 which additionally comprises building in front of said rear wall, a front wall composed of juxtaposed and superposed prefabricated slabs of reinforced concrete equipped with second reinforcing bars perpendicular to said slabs, joining said second reinforcing bars perpendicular to said slabs with said first reinforcing bars traversing said prefabricated panels whereby a free space is left between said slabs and said rear wall and casting in said free space a sealing layer composed of asphalt mastic, of cement bentonite or concrete.

* * * * *